US006279581B1

(12) United States Patent
Knepper

(10) Patent No.: US 6,279,581 B1
(45) Date of Patent: Aug. 28, 2001

(54) PORTABLE CIGAR HUMIDOR

(76) Inventor: William D. Knepper, Two Caras Ct., 352 Dreshertown Rd., Fort Washington, PA (US) 19034-3009

( * ) Notice: Subject to any disclaimer, the term of this patent is extended or adjusted under 35 U.S.C. 154(b) by 0 days.

(21) Appl. No.: 09/327,014

(22) Filed: Jun. 7, 1999

Related U.S. Application Data

(60) Provisional application No. 60/088,718, filed on Jun. 10, 1998.

(51) Int. Cl.[7] ..... A24F 13/00; B65D 30/22; B65D 81/26

(52) U.S. Cl. ..... 131/329; 131/290; 383/210; 383/38; 206/204; 206/205; 206/213.1; 206/242; 206/258; 206/256; 206/260

(58) Field of Search ..... 131/329, 290; 383/210, 38; 312/31, 31.2; 206/204, 205, 213.1, 242, 256, 258, 260

(56) References Cited

U.S. PATENT DOCUMENTS 2,537,196 * 1/1951 Tanski ..... 213/31.2
3,471,005 * 10/1969 Sexstone ..... 206/41
3,815,828 * 6/1974 Engel ..... 239/56
5,901,710 * 5/1999 Barber ..... 131/274
5,938,012 * 8/1999 Yeager et al. ..... 206/205

* cited by examiner

*Primary Examiner*—James Derrington
*Assistant Examiner*—Dionne A. Walls
(74) *Attorney, Agent, or Firm*—Dann, Dorfman, Herrell & Skillman, P.C.

(57) ABSTRACT

A portable, flexible humidor for cigars is provided. A flexible cigar storage compartment and a flexible moisture control compartment are connected by a passageway having a staggered series of channels which permit moisture-laden air to flow from one compartment to another while deterring the flow of liquid. Cigars are stored in the flexible cigar storage compartment and a moist sponge is inserted in the flexible moisture control compartment. Both compartments have resealable openings which permit the user to repetitively open and close the compartments to gain access to the cigars and the sponge.

31 Claims, 1 Drawing Sheet

PORTABLE CIGAR HUMIDOR

RELATED APPLICATIONS

This application is utility application of provisional application Ser. No. 60/088,718, entitled "Portable Cigar Humidor," filed on Jun. 10, 1998, such applications being incorporated herein by reference.

FIELD OF THE INVENTION

The present invention relates to a device for storing cigars and, more specifically, to a portable, flexible pouch for storing cigars at a selected humidity level.

BACKGROUND OF THE INVENTION

The desirability of maintaining cigar freshness has been recognized for many years. In effort to prevent cigars from drying out or becoming stale, various types of devices have been used over the years to store cigars at a selected humidity level. Typically, cigar humidors have been large or rigid cases designed for use at fixed locations such as the home, club, or other smoking areas. These conventional hard or rigid cases are not typically suited for portability. These cases are usually too bulky or too hard to be easily carried.

Depending on atmospheric conditions, unwrapped cigars can lose freshness or become stale in a relatively short period of time. In an effort to maintain cigar freshness, cellophane wrappers have been used to retard moisture loss. Unfortunately, the cellophane wrappers do not function to completely prevent moisture loss but only to retard it. Consequently, even wrapped cigars become stale over time. Cellophane wrappers have no capability of replacing lost moisture.

SUMMARY OF THE INVENTION

In accordance with the present invention, a portable unit in the form of a portable cigar humidor is provided for maintaining the selected humidity level for cigars. The cigar humidor includes a flexible cigar storage compartment for storing cigars. The cigar storage compartment may be in the form of a flexible, openably resealable pouch for storing a predetermined number of cigars. A resealable opening is provided for repetitive opening and closing of the cigar storage compartment. The resealable opening may be in the form of a flexible pressure seal, such as a zip-lock seal, to effect convenient opening and secure sealing of the cigar storage compartment.

Additionally, the cigar humidor includes a flexible moisture control compartment for storing a moisture control medium. The moisture control medium provides a moisture reservoir and may be in the form of a sponge. The moisture control compartment may be in the form of a small pouch relative to the size of the cigar storage pouch. The moisture control compartment may have a resealable opening to effect repetitive opening and closing of the compartment in order to permit removal and remoisturizing of the moisture control medium. The resealable opening may be in the form of a flexible pressure seal, such as a zip-lock seal, to effect convenient opening and secure sealing of the moisture control compartment.

A moisture communication section joins the cigar storage compartment and the moisture control compartment. The moisture communication section comprises a passageway for the communication of moisture-laden air from the moisture control compartment to the cigar storage compartment. The passageway may include a series of staggered barriers to provide a channel having a tortuous, winding path to inhibit any leakage of liquid from the moisture control compartment from penetrating the cigar storage compartment and damaging the cigars. The humidor may be integrally formed from a flexible, plastic material so that the moisture communication section joins the cigar storage compartment with the moisture control compartment as a flexible, generally flat unit with a resealable cigar storage pouch at one end and a smaller moisture control pouch at the other end.

BRIEF DESCRIPTION OF THE DRAWINGS

The foregoing summary, as well as the following detailed description of the preferred embodiments of the present invention, will be better understood when read in conjunction with the accompanying drawings, in which.

BRIEF DESCRIPTION OF THE PREFERRED EMBODIMENTS OF THE INVENTION

Figure 1:
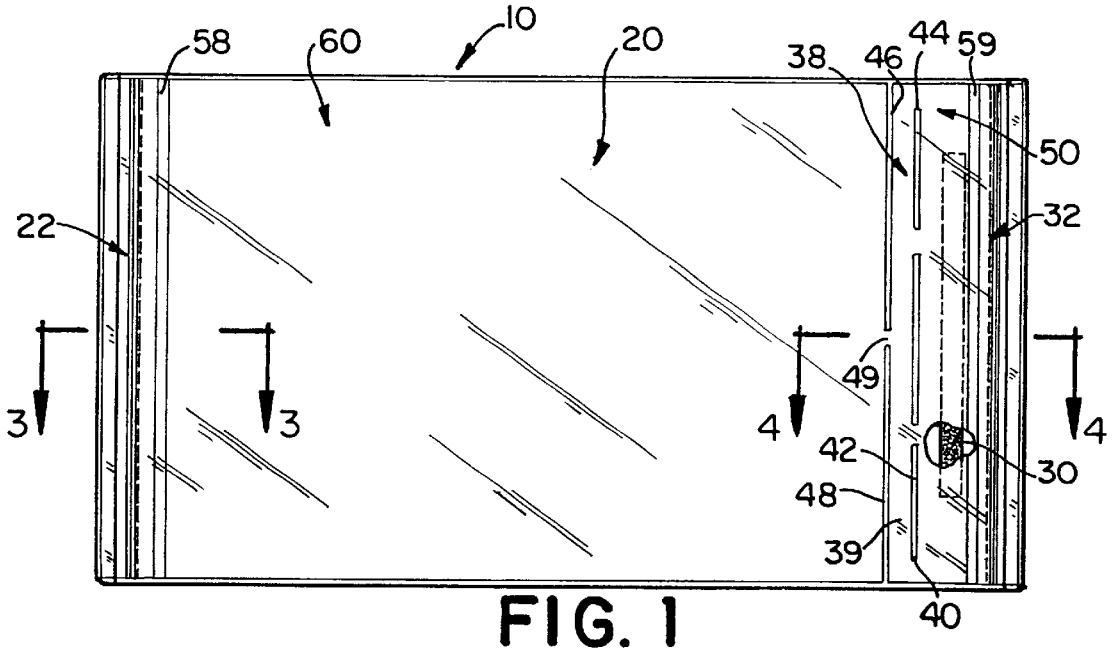
FIG. 1 is a plan view of the cigar humidor with a portion cutaway to depict a moisture holding medium.
Figure 2:
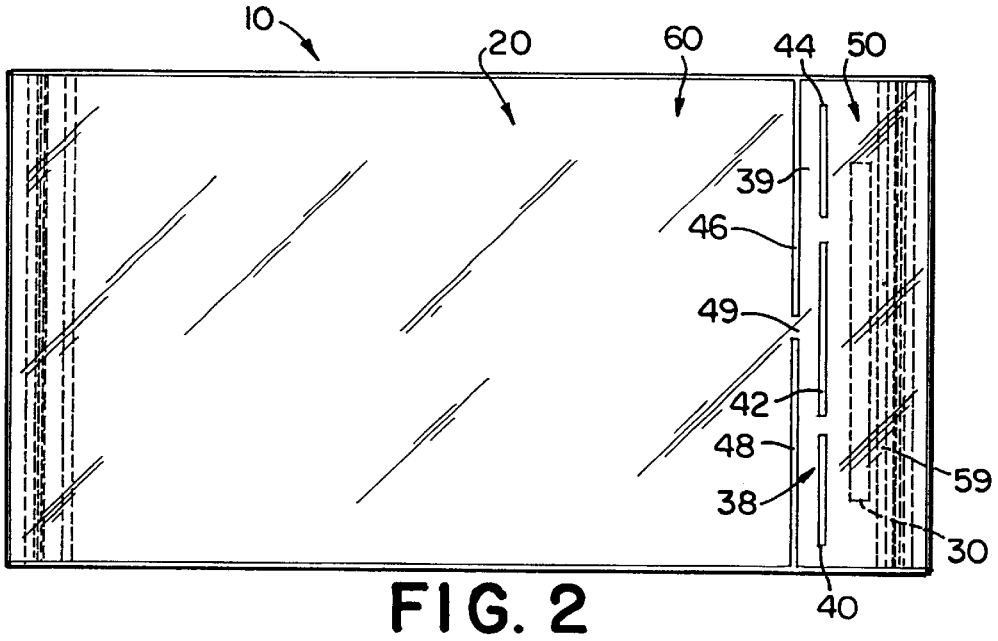
FIG. 2 is a bottom view of the cigar humidor.

Referring to FIGS. 1 and 2, a portable cigar humidor, generally designated 10, is provided for storing cigars at a selected humidity level. In addition, the portable cigar humidor 10 may be used to impart the cigars with a special flavor, e.g. brandy or cordials. Further, the portable cigar humidor 10 may be used to dehumidify cigars that have become too damp. The humidor 10 may be formed into a flexible, multi-compartment carry pouch from a pair of generally rectangular flexible plastic front and back sheets 55 and 56 that are heat sealed about the perimeter to form a generally flat, rectangular enclosure 60.

Generally, the portable cigar humidor 10 provides a resealably, openable air-tight enclosure 60 which comprises a generally rectangular cigar storage compartment 20 of a sufficient length and width to hold a plurality of cigars of a selected length and a moisture control compartment 50 of a sufficient size to contain an appropriately-sized moisture control medium 30 to effect humidity control. The cigar storage compartment 20 and the moisture control compartment 50 are joined together at their bottom ends by an intermediate moisture communication section 38 providing an indirect passageway 39 between the cigar storage compartment 20 and the moisture control compartment 50. The passageway is in the form of channel or series of channels providing a tortuous path between the cigar storage compartment and the moisture control compartment. A series of staggered barriers 40, 42, 44, 46, and 48 provide the channel for moisture communication between compartments 20 and 50. A top end of the cigar storage compartment 20 has a resealable opening 22 formed by mating pressure seal edges 24 and 25 which permit access to the cigars. A top end of the moisture control compartment 50 also has a resealable opening 32 formed by mating pressure seal edges 34 and 35 which permit the removal of the moisture control medium 30.

Figure 3:
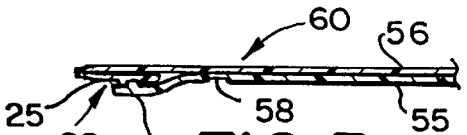
FIG. 3 is a cross-sectional view of the cigar humidor taken along line 3—3 of FIG. 1.
Figure 4:
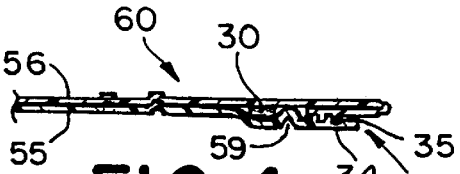
FIG. 4 is a cross-sectional view of the cigar humidor taken along line 4—4 of FIG. 1.

The enclosure 60 is formed or molded from a suitable flexible material, i.e. plastic, in a suitable size, e.g. 6 inches wide and 11 inches long, to hold a selected size and number of cigars. The flexible material of the enclosure 60 enables the cigar humidor 10 to be folded and placed inside the user's coat pocket or purse. The enclosure is light weight and non-rigid making it easy to carry. When empty, the enclosure lies generally flat as best seen in FIGS. 3 and 4.

The cigar storage compartment 20 is provided in a suitable size, for example, approximately 9 inches long, to permit the storing of several average sized cigars. The size of the cigar storage compartment 20 can be modified to store a different size of cigar or to store a larger or smaller number of cigars. The resealable pressure seal edges 24 and 25 are provided as overlapping, mating strips on the front sheet 55 of the enclosure 60 and are located at one end of the enclosure 60 at an end portion of the cigar storage compartment 20. The pressure seal edges are in the form of pressure seal, or zip-lock, strip extending generally across the width of the enclosure 60. The pressure seal edges can be repetitively opened and resealed to add or remove cigars from the cigar storage compartment 20. The resealable opening 22 provided by pressure seal edges 24 and 25 can be opened and closed by aligning the top seal edge 24 over the bottom seal edge 25 and pressing them together along their length. A barrier ridge 58 is heat molded into the front sheet 55. The barrier ridge 58 is spaced slightly inwardly from the pressure seal edges 24 and 25 and extends generally parallel and coextensive with the pressure seal edges 24 and 25. As best seen in FIG. 3, the barrier ridge 58 projects inwardly into the cigar storage compartment 20 to engage the inside face of back sheet 56 to enhance the sealing of the cigar storage compartment 20.

The moisture control compartment 50 is provided in a suitable size, for example, 1 to 2 inches along the length of the enclosure 60, to permit the storing of a moisture control medium 30 of a sufficient size and capacity to function as a moisture reservoir to maintain the selected humidity level in the cigar humidor 10. The resealable opening 32 provided by pressure seal edges 34 and 35 can be repetitively opened and resealed to add or remove the moisture absorbing medium 30 from the moisture control compartment 50. The pressure seal edges 34 and 35 are provided as overlapping, mating strips on the front sheet 55 of the enclosure 60 and are located at an end of the enclosure 60 at an end portion of the moisture control compartment 50. The pressure seal edges 55 and 56 are in the form of a pressure seal, or zip-lock, strip extending generally across the width of the enclosure. The pressure seal edges can be repetitively opened and resealed to add or remove the moisture control medium 30. The resealable opening 32 provided by the pressure seal edges 55 and 56 can be opened and closed by aligning the top edge 34 over the bottom edge 35 and pressing them together along their length. A barrier ridge 59 is heat molded into the front sheet 55. The barrier ridge 59 is spaced slightly inwardly from the pressure seal edges 34 and 35 and extends generally parallel and coextensive with the pressure seal edges 34 and 35. As best seen in FIG. 4, the barrier ridge 59 projects into the moisture control compartment 20 to engage the inside face of back sheet 56 to enhance the sealing of the moisture control compartment 20.

The moisture control medium 30 may be in the form of a sponge which may be selectively moistened to introduce humidity into the cigar humidor 10. The sponge may be in the shape of an elongated, relatively flat strip for positioning within the moisture control compartment 30. The size or type of the sponge can be changed to hold different amounts of moisture. Alternatively, the moisture control medium 30 may be in some other form such as a gel or paper. The moisture control medium 30 is removable from the moisture control compartment 50 though the resealable opening 32. The moisture control sponge 30 is moistened in water and any excess water is wrung from the sponge. The moisturized sponge is then placed inside the moisture control compartment 50. The moisture control medium 30 may also be moistened with flavored liquids, such as brandy or cordials, to impart a special flavor to the cigars.

Once the moisture control medium is in place inside the moisture control compartment 50, the pressure seal edges 34 and 35 are resealed to prevent the escape of moisture into the air. The precise humidity level is controlled by the size of the moisture control medium 30. If the humidity level is not high enough and, as a result, the cigars are stale and dry, then a larger moisture control medium 30 can be used. On the other hand, if the humidity level is too high and the cigars become damp or wet, then a smaller moisture control medium 30 can be used or the existing moisture control medium 30 can be cut to a smaller size. Additionally, further excess moisture in the moisture control medium 30 can be squeezed out or evaporated in air to ensure that the humidity level is not too high.

Moisture communication is effected between the moisture control compartment 50 and the cigar storage compartment 20 through the moisture communication section 38 that joins the moisture control compartment 50 with the cigar storage compartment 20. The moisture communication section 38 provides a passageway 39 in the form of an indirect, staggered channel having one or more branches extending between the moisture control compartment and the cigar storage compartment. The channel 39 provides gas flow communication between the moisture control compartment and the cigar storage compartment so that moisture-laden air from the moisture control compartment flows to the cigar storage compartment while the flow of liquid into the cigar storage compartment is inhibited. The channel 39 is provided by a series of staggered, spaced-apart barriers 40, 42, 44, 46 and 48 that are formed as inwardly projecting ridges in the moisture communication section of the enclosure by heat pressing the top sheet 55 and the bottom sheet 56 of the enclosure together in a selected pattern. The series of barriers 40, 42, 44, 46, and 48 are provided to permit gas flow communication between the cigar storage compartment 20 and the moisture control compartment 50. As shown in FIGS. 1 and 2, the series of barriers 40, 42, 44, 46, and 48 may be oriented generally transversely across the enclosure 60 of the cigar saver 10 to separate the moisture control compartment and the cigar storage compartment. Barriers 46 and 48 are colinear and extend from the respective sides of the enclosure transversely toward the center of the enclosure to provide a barrier row with a small central air gap 49 therebetween. Barriers 40, 42, and 44 are colinear and extend transversely across the enclosure in a barrier row generally parallel to the row of barriers 46 and 48. The barriers 40, 42, and 46 are spaced apart from each other and from the sides of the enclosure to provide air gaps therebetween. The air gaps between barriers 40, 42 and 46 are offset from the central air gap 49 provided between barriers 46 and 48 so that the gas flow channel through the air gaps is provided as an indirect tortuous path. After the moisture control medium 30 is inserted in the moisture control compartment 50, humidity travels from the moisture control compartment 50 through the series of channels between barriers 40, 42, 44, 46, and 48 and into the cigar storage compartment 20.

By staggering the series of barriers 40, 42, 44, 46, and 48, liquid is prevented, or at least inhibited, from penetrating the cigar storage compartment 20 and damaging the cigars. Additional channels and barriers can be added for extra protection. Alternative arrangements of barriers or channels may also be provided other than the barrier rows.

The humidor can be used to help maintain cigar freshness. The humidor can also be used to aid in reviving dried or somewhat stale cigars. Finally, the humidor can be used in reverse to extract moisture from excessively moist or wet cigars by using a dry sponge or desiccant in the moisture control compartment.

It will be recognized by those skilled in the art that changes or modifications may be made to the above-described embodiments without departing from the broad inventive concept of the invention. It should therefore be understood that this invention is not limited to the particular embodiments described herein but is intended to include all changes and modifications that are within the scope and spirit of the invention as set forth in the following claims.

What is claimed is:

1. A portable pouch for storing cigars, comprising:

a) a flexible, openably resealable cigar storage compartment for storing cigars;

b) a moisture control compartment for storing a moisture control medium; and c) a moisture communication section having a channel between the storage compartment and the moisture control compartment for providing moisture communication between the cigar storage compartment and the moisture control compartment while inhibiting liquid flow between the moisture control compartment and the cigar storage compartment, the channel having a series of liquid barriers to deter liquid flow from the moisture control compartment to the cigar storage compartment.

2. The pouch according to claim 1 wherein the flexible cigar storage compartment includes a resealable opening that is capable of repetitive opening and closing so that a user can gain access to the cigars in the cigar storage compartment.

3. The pouch according to claim 1 wherein the moisture control compartment includes a resealable opening that is capable of repetitive opening and closing so that a user can gain access to the moisture control compartment.

4. The pouch according to claim 3 wherein the moisture control compartment contains a moisture source.

5. The pouch according to claim 4 wherein the moisture source includes a rewettable moisture holding medium removable from the moisture control compartment by opening and closing the resealable opening of the moisture control compartment.

6. The pouch according to claim 3 wherein the moisture holding medium holds a cigar flavoring substance.

7. The pouch according to claim 3 wherein the moisture control compartment contains a desiccant.

8. The pouch according to claim 1 wherein the moisture control compartment contains a moisture source.

9. The pouch according to claim 1 wherein the moisture control compartment contains a desiccant.

10. A portable pouch for storing cigars, comprising:

a) a flexible, openably resealable cigar storage compartment for storing cigars;

b) a moisture control compartment for storing a moisture control medium; and c) a moisture communication section having an indirect channel between the cigar storage compartment and the moisture control compartment for providing moisture communication between the cigar storage compartment and the moisture control compartment while inhibiting liquid flow between the moisture control compartment and the cigar storage compartment, the channel having a staggered passageway to prevent the leakage of liquid from the moisture control compartment into the cigar storage compartment.

11. A pouch for storing cigars comprising a flexible cigar storage compartment and a flexible moisture storage compartment, which contains a moisture source, with resealable openings on both compartments, connected by a moisture communication section comprised of a series of staggered channels to provide moisture communication between the compartments while deterring the flow of liquid therebetween.

12. A portable, flexible cigar humidor comprising:

a) a flexible cigar storage pouch for storing a predetermined number of cigars;

b) an openly resealable closure on the cigar storage pouch to permit insertion and removal of cigars;

c) a moisture control compartment for enclosing a medium for holding moisture; and d) a moisture communication section for providing moisture communication between the moisture control compartment and the cigar storage pouch to enable moisture flow between the cigar storage pouch and the moisture control compartment, the moisture communication section having a series of liquid barriers to deter liquid flow from the moisture control compartment to the cigar storage compartment.

13. The humidor according to claim 12 wherein the resealable closure includes a pressure-seal closure.

14. The humidor according to claim 12 wherein the moisture control compartment comprises a flexible moisture containment pouch.

15. The humidor according to claim 14 wherein the medium for holding moisture comprises a sponge.

16. The humidor according to claim 12 wherein the cigar storage pouch, the moisture control compartment, and the moisture communication section are integrally formed from a flexible plastic material.

17. The humidor according to claim 16 wherein the moisture control compartment includes an openably resealable closure to permit insertion and removal of the medium for holding moisture.

18. The humidor according to claim 12 wherein the moisture control compartment includes an openably resealable closure to permit insertion and removal of the medium for holding moisture.

19. The humidor according to claim 18 wherein the resealable closure on the cigar storage compartment and the resealable closure on the moisture control compartment each include a pressure-seal closure.

20. A portable, flexible cigar humidor comprising:

a) a flexible cigar storage pouch for storing a predetermined number of cigars;

b) an openably resealable closure on the cigar storage pouch to permit insertion and removal of cigars;

c) a moisture control compartment for enclosing a medium for holding moisture, the moisture control compartment having an openably resealable closure to permit insertion and removal of the medium for holding moisture; and d) a moisture communication section having an indirect channel between the cigar storage pouch and the moisture control compartment for providing moisture communication between the moisture control compartment and the cigar storage pouch to enable moisture flow between the cigar storage pouch and the moisture control compartment, the channel having a series of staggered barriers providing a tortuous path to deter liquid flow from the moisture control compartment to the cigar storage pouch, wherein the cigar storage pouch, the moisture control compartment, and the moisture communication section are integrally formed from a flexible plastic material.

21. A portable, flexible cigar humidor comprising:

a) a flexible cigar storage pouch for storing a predetermined number of cigars;

b) an openably resealable closure on the cigar storage pouch to permit insertion and removal of cigars;

c) a moisture control compartment for enclosing a medium for holding moisture; and d) a moisture communication section having an indirect channel between the cigar storage pouch and the moisture control compartment for providing moisture communication between the moisture control compartment and the cigar storage pouch to enable moisture flow between the cigar storage pouch and the moisture control compartment, the channel having a series of liquid barriers to deter liquid flow from the moisture control compartment to the cigar storage pouch.

22. A generally flat, portable, flexible cigar humidor of a flexible, plastic material comprising:

a) a flexible cigar storage pouch for storing a predetermined number of cigars;

b) an openably resealable flexible closure on the cigar storage pouch to permit insertion and removal of cigars;

c) a flexible moisture control pouch for enclosing a medium for holding moisture;

d) an openably resealable flexible closure on the moisture control pouch to permit removal of the medium for holding moisture to enable wetting of the medium; and e) a flexible moisture communication section joining the cigar storage pouch with the moisture control pouch for providing moisture communication between the moisture control pouch and the cigar storage pouch to enable moisture flow therebetween, the moisture communication section including a passageway having a winding channel to permit moisture flow between the moisture control pouch and the cigar storage pouch but to deter liquid flow therebetween.

23. A portable, flexible cigar humidor comprising:

a) a flexible cigar storage pouch for storing a predetermined number of cigars;

b) an openably resealable closure on the cigar storage pouch to permit insertion and removal of cigars;

c) a moisture control compartment for enclosing a medium for holding moisture, the moisture control compartment having an openably resealable closure to permit insertion and removal of the medium for holding moisture; and d) a moisture communication section having a series of staggered barriers to provide a tortuous path between the moisture control compartment and the cigar storage pouch to effect moisture transfer between the moisture control compartment and the cigar storage pouch but to inhibit liquid transfer therebetween;

wherein the cigar storage pouch, the moisture control compartment, and the moisture communication section are integrally formed from a flexible plastic material.

24. A portable pouch for storing cigars, comprising:

a) a flexible, openably resealable cigar storage compartment for storing cigars;

b) a moisture control compartment for storing a moisture control medium; and c) a moisture communication section having a channel between the cigar storage compartment and the moisture control compartment for providing moisture communication between the cigar storage compartment and the moisture control compartment while inhibiting liquid flow between the moisture control compartment and the cigar storage compartment, the channel having a series of staggered barriers providing a tortuous path to deter liquid flow from the moisture control compartment to the cigar storage compartment.

25. A portable pouch for storing cigars, comprising:

a) a flexible, openably resealable cigar storage compartment for storing cigars;

b) a moisture control compartment for storing a moisture control medium; and c) a moisture communication section having a channel between the cigar storage compartment and the moisture control compartment for providing moisture communication between the cigar storage compartment and the moisture control compartment while inhibiting liquid flow between the moisture control compartment and the cigar storage compartment, the channel having a winding passageway to permit moisture flow between the moisture control compartment and the cigar storage compartment but to deter liquid flow therebetween.

26. A portable, flexible cigar humidor comprising:

a) a flexible cigar storage pouch for storing a predetermined number of cigars;

b) a moisture control compartment for enclosing a desiccant; and c) a moisture communication section for providing moisture communication between the moisture control compartment and the cigar storage pouch to enable moisture flow between the cigar storage compartment pouch and the moisture control compartment, the moisture communication section having a series of liquid barriers to deter liquid flow from the moisture control compartment to the cigar storage compartment.

27. The pouch according to claim 26 wherein the flexible cigar storage compartment includes a resealable opening that is capable of repetitive opening and closing so that a user can gain access to the cigars in the cigar storage compartment.

28. The humidor according to claim 27 wherein the resealable closure includes a pressure-seal closure.

29. A portable, flexible cigar humidor comprising:

a) a flexible cigar storage pouch for storing a predetermined number of cigars;

b) a moisture control compartment for enclosing a desiccant; and c) a moisture communication section for providing moisture communication between the moisture control compartment and the cigar storage pouch to enable moisture flow between the cigar storage compartment pouch and the moisture regulation compartment, the moisture communication section including a series of staggered barriers providing a tortuous path to deter liquid flow from the moisture control compartment to the cigar storage pouch.

30. A portable, flexible cigar humidor comprising:

a) a flexible cigar storage pouch for storing a predetermined number of cigars;

b) a moisture control compartment for enclosing a desiccant; and c) a moisture communication section for providing moisture communication between the moisture control compartment and the cigar storage pouch to enable moisture flow between the cigar storage compartment pouch and the moisture regulation compartment, the moisture communication section including a winding passageway to permit moisture flow between the moisture control compartment and the cigar storage pouch but to deter liquid flow therebetween.

31. A portable pouch for storing cigars, comprising:

a) a flexible, openably resealable cigar storage compartment for storing cigars;

b) a moisture control compartment for storing a moisture control medium; and c) a moisture communication section for providing moisture communication between the cigar storage compartment and the moisture control compartment, the moisture communication section comprising a passageway having a staggered channel to inhibit liquid flow between the moisture control compartment and the cigar storage compartment.

* * * * *